United States Patent [19]

Zeigler

[11] Patent Number: 4,651,365

[45] Date of Patent: Mar. 24, 1987

[54] PORTABLE ADJUSTABLE BED RAISER

[76] Inventor: Paul R. Zeigler, Ithaca Rd., Horseheads, N.Y. 14845

[21] Appl. No.: 675,288

[22] Filed: Nov. 27, 1984

[51] Int. Cl.[4] ..... A61G 7/06; A47C 20/04; A47C 20/02

[52] U.S. Cl. ..... 5/74 R; 5/71; 5/433

[58] Field of Search ..... 5/74 R, 74 B, 71, 72, 5/80, 433, 66–69, 60, 70

[56] References Cited

U.S. PATENT DOCUMENTS

| | | | |
|---|---|---|---|
| 268,600 | 12/1882 | Baggs | 5/74 B |
| 471,895 | 3/1892 | Reeves | 5/71 |
| 1,280,792 | 10/1918 | MacEachern | 5/62 |
| 1,361,420 | 12/1920 | Van Dolsen | 5/60 |
| 2,387,357 | 10/1945 | Rogerson | 5/71 |
| 2,744,522 | 5/1956 | Washer | 5/71 |
| 2,999,920 | 9/1961 | Brown | 5/68 |
| 3,191,196 | 6/1965 | Holm | 5/68 |
| 3,201,806 | 8/1965 | Hutt | 5/62 |
| 3,981,031 | 9/1976 | Schacht | 5/72 |
| 4,183,109 | 1/1980 | Howell | 5/68 |

FOREIGN PATENT DOCUMENTS

| | | | |
|---|---|---|---|
| 246846 | 3/1912 | Fed. Rep. of Germany | 5/74 |
| 651916 | 1/1963 | Italy | 5/433 |
| 462839 | 3/1937 | United Kingdom | 5/433 |

*Primary Examiner*—Alexander Grosz

*Attorney, Agent, or Firm*—Saidman, Sterne, Kessler & Goldstein

[57] ABSTRACT

A portable bed raiser placed under one end of a mattress for adjustably raising and lowering that end of the mattress. The apparatus provides a lightweight, economical alternative to a complex, expensive hospital-type bed. This apparatus is easily compatible with standard beds and can be set up and removed at the convenience of the user.

19 Claims, 4 Drawing Figures

PORTABLE ADJUSTABLE BED RAISER

BACKGROUND OF THE INVENTION

1. Field of the Invention

The present invention is related to an adjustable bed raiser, to raise one end of a bed, and more particularly towards a portable adjustable bed raiser for health or leisure purposes, that is economical, lightweight, can be used with a standard bed with or without a boxspring, and can be set up and taken down at the user's convenience with a minimum of effort. The invention also contemplates the use of two portable bed raisers for independently raising and lowering each end of a mattress.

2. Description of the Related Art

Hospital, obstetric and other beds which provide for the raising and lowering of the head or foot portions of the bed's mattress are commonly known in the art. These beds have traditionally been expensive, heavy, and mechanically complex, and the apparatus for raising and lowering the mattress is usually integrally constructed with the bed frame itself. This tends to make the bed generally unsightly, especially for use in the home. See, for example, U.S. Pat. Nos. 2,999,920 to Brown, 3,201,806 to Hutt and 3,191,196 to Holm.

The obstetrical bed taught by MacEachern (U.S. Pat. No. 1,280,792) and the operating table taught by Van Dolsen (U.S. Pat. No. 1,361,420) teach beds with pivotably mounted tops wherein the mechanical structure for raising and lowering the tops is an integral part of the frame of the bed.

No portable bed raising apparatus is known that can be conveniently placed under one end of a mattress of a standard bed for raising and lowering that end of the mattress which is simple, reliable and relatively inexpensive that can be quickly and efficiently removed from the bed and conveniently stored for later use.

SUMMARY OF THE INVENTION

This invention comprises a portable bed raiser for raising and lowering one end of a mattress of a standard bed that includes the mattress and a frame supporting the mattress. The bed raiser has a vertical support member extending above the mattress, a horizontal support member extending from the vertical support member, means for supporting the mattress disposed under one end of the mattress pivotably connected to the outer end of the horizontal support member, means for reciprocally connecting the upper end of the supporting means to the vertical support member to allow relative movement therebetween, and means for moving the supporting means relative to the horizontal support member.

The supporting means preferably comprises a frame having an upper cross member and a lower cross member interconnected by an pair of outer cross members, and comprises a first and second plurality of wires respectively longitudinally extending between the upper cross member and the lower cross member and laterally extending between the pair of outer cross members. The wires are terminated by hook means for fastening onto the cross members and the first and second plurality of wires cross one another.

The outer cross members each have an internal axial bore. The connecting means comprises a slide rod having an elongated portion slidably disposed within the axial bore in each one of the outer cross members. A flange having first and second portions is also provided. The first portion of the flange is slidably disposed within the longitudinal slot in the vertical support member and the second portion extends outwardly from the vertical support member. A pivot pin pivotably connects the slide rod to the second portion of the flange.

The means for moving the connecting means relative to the horizontal support member preferably comprises an elongated internal guide rod, slidably disposed within the vertical support member, having first and second sections. The first section of the guide rod is rigidly connected to the first portion of the flange, and a linear gear is attached to the second section of the guide rod and extends outwardly from the slot in the vertical support member. Means operatively connected to the linear gear is provided for sliding the guide rod within the vertical support member. Such means preferably includes a circular gear meshing with the linear gear and an electrically-operated reversible motor connected to the circular gear. Means for remotely controlling said motor are also provided.

In an alternative embodiment, the invention comprises a second portable bed raiser which is substantially identical to the first portable bed raiser wherein the second portable bed raiser is disposed under the end of the mattress remote from the first portable bed raiser so that each end of the mattress may be independently raised and lowered.

BRIEF DESCRIPTION OF THE DRAWINGS

Additional objects, features and attendant advantages of the present invention will become more readily apparent as the invention becomes more fully understood from the following detailed description of the invention considered in connection with the accompanying drawings in which like reference numerals represent identical or corresponding part throughout the several views, wherein.

DESCRIPTION OF THE PREFERRED EMBODIMENTS

Figure 1:
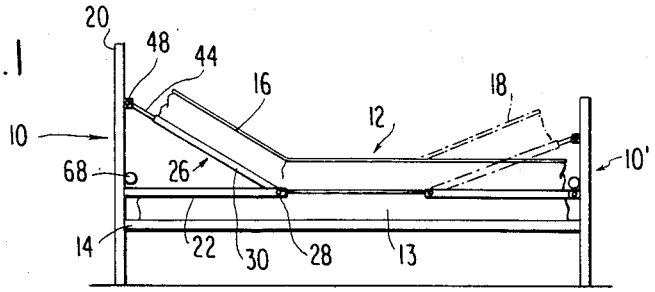
FIG. 1 is a side elevational view of two portable bed raisers of the present invention, the operation of the second portable bed raiser being shown in ghost lines.
Figure 2:
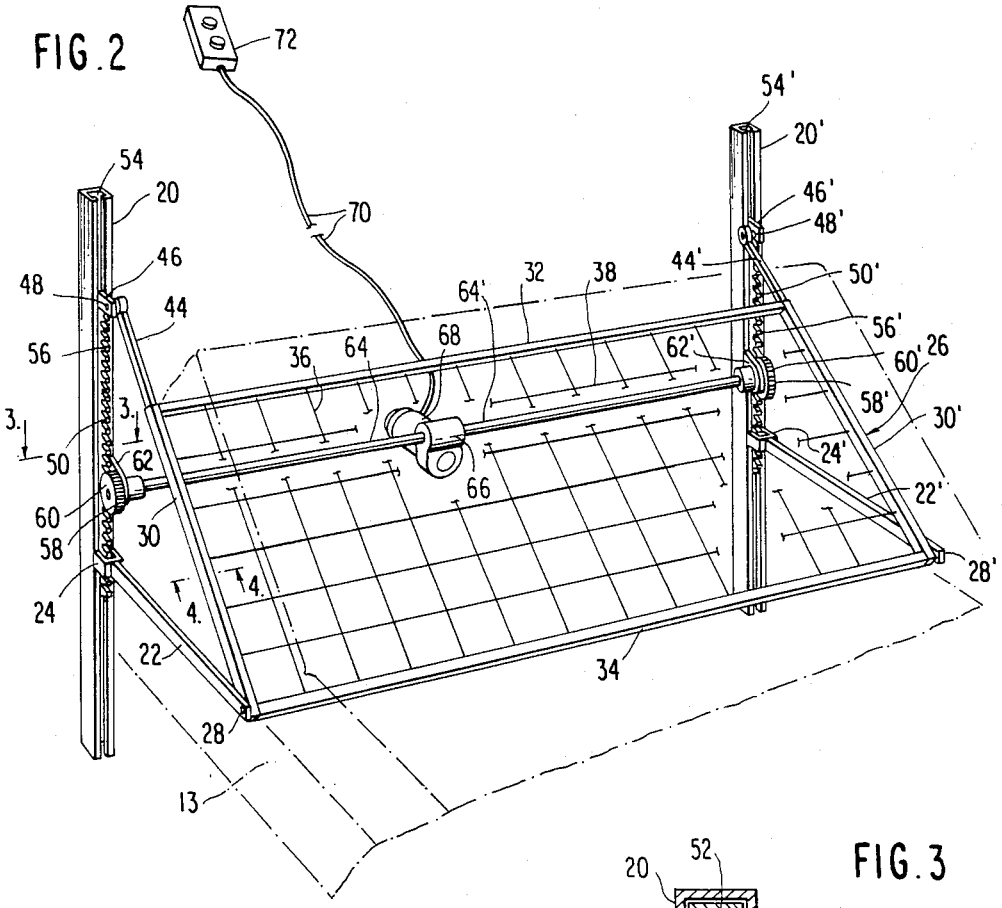
FIG. 2 is a perspective view of a preferred embodiment of the portable bed raiser of the present invention.
Figure 3:
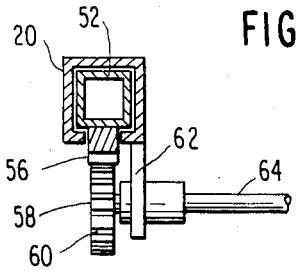
FIG. 3 is a cross-sectional view of the vertical support member, the guide rod and the moving means taken along line 3—3 of FIG. 2.
Figure 4:
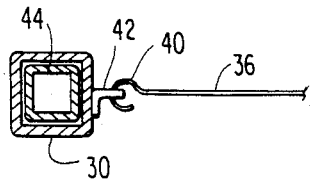
FIG. 4 is a cross-sectional view of an outer cross member showing the slide rod and the connection of a wire to the cross member taken along 4—4 of FIG. 2.

Referring now to the drawings, wherein like reference numerals represent identical or corresponding parts throughout the several views, and more particularly to FIG. 1, there is shown two portable bed raisers, generally designated respectively at 10 and 10'. Each portable bed raiser 10 and 10' independently operates in the same manner. Thus, for efficiency, the operation and function of only one portable bed raiser need be described in detail herein.

The portable bed raiser 10 is placed in practice underneath one end 16 of a mattress 12 and above the bed frame 14 or a box spring 13. A second portable bed raiser 10' may be placed under the other end 18 of mattress 12.

In the preferred embodiment, portable bed raiser 10 comprises a pair of vertical support members 20, 20' connected respectively to a pair of horizontal support members 22, 22'. For added strength and stability, this connection may be made by means of pair of U-shaped brackets 24, 24' which are disposed between vertical support members 20, 20' and horizontal support members 22, 22'.

The outer end of horizontal support member 22 is pivotably connected by means of a pivot pin 28 to a movable supporting means shown generally at 26. The movable supporting means comprising a pair of outer cross members 30, 30', an upper cross member 32, and a lower cross member 34.

In one embodiment, a plurality of laterally extending wires 38 are disposed between the pair of outer cross members 30, 30' and a plurality of longitudinally extending wires 36 are disposed between the upper and lower cross member 32 and 34 respectively. These wires may be terminated by hook means 40 for fastening onto the cross members. The hooks may alternately connect to an angle iron 42 attached to each cross member. Wires 36 and 38 may cross over one another at their respective intersections for added strength and stability.

The supporting means 26 is connected to the vertical support members 20, 20' by means of a pair of slide arms 44, 44'. The slide arms 44, 44' are slidably disposed within an axial bore formed within each outer cross member 30, 30'. Slide rods 44 and 44' are respectively connected to vertical support members 20 and 20' by means of outwardly extending flanges 46, 46' and a pair of pivot pins 48, 48'. Each flange 46, 46' is connected to a guide rod 52, 52' which is slidably disposed within respective vertical support members 20 and 20'. Each flange 46, 46' extends outwardly from a longitudinal slot 54, 54' formed in vertical support members 20, 20'.

Linear gears 50, 50' are also attached to the guide rods 52, 52'. Each linear gear 50, 50' is moved within each vertical support member 20, 20' by meshing of its teeth 56, 56' with the teeth 58, 58' of circular gears 60, 60'. Each gear 60, 60' is journalled in a lower flange 62, 62' which is attached respectively to the vertical support members 20, 20'. Each circular gear 60, 60' is operatively attached to a drive shaft 64 which is connected to an electric motor 68 by means of a transmission 66. Motor 68 is preferably a reversible motor which may be operated by a remote control switch 72 which may be electrically connected to motor 68 by means of a cable 70.

In operation, the user will depress a switch in remote control 72 which will result in the rotational movement of motor 66. This rotational force is imparted to each circular gear 60, 60' by means of the drive shaft 64 and the transmission 66. The circular gears 60, 60' rotate and slide linear gears 50, 50' (which are connected to the lower end of guide rods 52, 52') vertically within vertical slots 54, 54' of vertical support members 20, 20'. As each guide rod 52, 52' moves, supporting means 26 is similarly moved in the same direction by means of flanges 46, 46', connected to guide rods 52, 52', which are pivotably connected by pivot pins 48, 48' to slide rods 44, 44, the slide rod being slidably disposed within each outer support member 30, 30'. Thereby, vertical movement of the guide rod causes the supporting means 26 to pivotably move about its lower pivot pins 28, 28', thereby raising one end 16 of mattress 12 supported thereby.

While the invention has been described with respect to the preferred embodiment shown herein, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

What I claim is:

1. A portable bed raiser for raising and lowering one end of a mattress of a standard bed that includes the mattress and a frame supporting the mattress, comprising:

a vertical support member extending above the mattress and having a longitudinal slot therein;

a horizontal support member having first and second ends, said first end attached to said vertical support member;

means disposed under the mattress for supporting one end of the mattress, said means having upper and lower ends, said lower end pivotably connected to said second end of said horizontal support member;

means for reciprocally connecting said upper end of said supporting means to said vertical support member to allow relative movement therebetween; and motor means for moving said supporting means relative to said horizontal support member; said motor means including means for sliding said connecting means downwardly and upwardly along said vertical support member.

2. A portable bed raiser as recited in claim 1, wherein said supporting means comprises a frame having an upper cross member and a lower cross member interconnected by a pair of outer cross members.

3. A portable bed raiser as recited in claim 2, wherein said cross members are attached to one another.

4. A portable bed raiser as recited in claim 3, wherein said supporting means further comprises a first and second plurality of wires respectively longitudinally extending between said upper cross member and said lower cross member and laterally extending between said pair of outer cross members.

5. A portable bed raiser as recited in claim 4, wherein said wires are terminated by hook means for fastening onto said cross members and wherein said first and second plurality of wires cross one another.

6. A portable bed raiser as recited in claim 2, wherein said outer cross members each have an internal axial bore.

7. Apparatus as recited in claim 1, further comprising a second portable bed raiser, wherein said second portable bed raiser is substantially identical to the first recited portable bed raiser and wherein said second portable bed raiser is disposed under the other end of the mattress remote from the first portable bed raiser so that each end of the mattress may be independently raised and lowered.

8. A portable bed raiser, comprising:

means for raising and lowering one end of a mattress of a standard bed that includes the mattress and a frame supporting the mattress, said means comprising:

a vertical support member extending above the mattress and having a longitudinal slot therein;

a horizontal support member having first and second ends, said first end attached to said vertical support member;

means disposed under the mattress for supporting one end of the mattress, said means including a pair of rigid members telescopically movable with respect to each other, and having upper and lower ends, said lower end pivotably connected to said second end of said horizontal support member;

means for reciprocally connecting said upper end of said supporting means to said vertical support member to allow relative movement therebetween;

means for pivotally moving said supporting means relative to said horizontal support member, said moving means including means for sliding said connecting means downwardly and upwardly along said vertical support member.

9. A portable bed raiser for raising and lowering one end of a mattress of a standard bed that includes the mattress and a frame supporting the mattress, comprising:

a vertical support member extending above the mattress and having a longitudinal slot therein;

a horizontal support member having first and second ends, said first end attached to said vertical support member;

means disposed under the mattress for supporting one end of the mattress, said supporting means comprising a frame having an upper cross member and a lower cross member interconnected by a pair of outer cross members and having upper and lower ends, said lower end pivotably connected to said second end of said horizontal support member;

means for reciprocally connecting said upper end of said supporting means to said vertical support member to allow relative movement therebetween, said connecting means further comprising a slide rod having an elongated portion slidably disposed within said axial bore in one of said outer cross members, a flange, having first and second portions, wherein said first portion is slidably disposed within said longitudinal slot in said vertical support member and wherein said second portion extends outwardly from said vertical support member, and a pivot pin pivotably connecting said slide rod to said second portion of said flange; and means for moving said supporting means relative to said horizontal support member.

10. A portable bed raiser as recited in claim 9, wherein said means for moving said connecting means relative to said horizontal support member comprises:

an elongated internal guide rod, slidably disposed within said vertical support member, having first and second sections, wherein said first section of said guide rod is rigidly connected to said first portion of said flange;

a linear gear attached to said second section of said guide rod and extending outwardly from said slot in said vertical support member; and means operatively connected to said linear gear for sliding said guide rod within said vertical support member.

11. A portable bed raiser as recited in claim 10, wherein said sliding means comprises a circular gear meshing with said linear gear, and a motor operatively connected to said circular gear.

12. A portable bed raiser as recited in claim 11, wherein said motor is electrically operated and reversible.

13. A portable bed raiser as recited in claim 12, further comprising means for remotely controlling said motor.

14. A portable bed raiser, comprising:

means for raising and lowering one end of a mattress of a standard bed that includes the mattress and a frame supporting the mattress, said means comprising:

a vertical support member extending above the mattress and having a longitudinal slot therein;

a horizontal support member having first and second ends, said first end attached to said vertical support member;

means for supporting said mattress, disposed under said mattress, having upper and lower ends, wherein said lower end is pivotably connected to said second end of said horizontal support member, further comprising a frame having an upper cross member and a lower cross member interconnected by a pair of outer cross members, said outer cross members each having an internal bore;

a first and second plurality of wires longitudinally extending between said upper cross member and said lower cross member and laterally extending between said pair of outer cross members, respectively, wherein said wires are terminated by hook means for fastening onto said cross members and wherein said first and second plurality of wires cross one another, respectively;

means for reciprocally connecting said upper end of said means for support to said vertical support member to allow relative movement therebetween comprising a slide rod slidably disposed within said axial bore in at least one of said outer cross members; a flange, having first and second portions, wherein said first portion of said flange is slidably disposed within said longitudinal slot in said vertical support member and wherein said second portion extends outwardly from said vertical support member; and a pivot pin pivotably connecting said slide rod to said second portion of said flange; and means for moving said supporting means relative to said horizontal support member comprising an elongated internal guide rod slidably disposed within said vertical support member, having first and second sections, wherein said first section is rigidly connected to said first portion of said flange; a linear gear, attached to said second portion of said guide rod, extending outwardly from said slot in said vertical support member; a circular gear, meshing with said linear gear; and an electrically operated motor rotatably connected to said circular gear, wherein said motor is reversible and further comprising means for remotely controlling said motor.

15. A bed raiser, comprising:

means for raising and lowering one end of a mattress of a bed that includes the mattress and a frame supporting the mattress, said means comprising:

first and second substantially vertical support members extending above the mattress;

means disposed under the mattress for supporting one end of the mattress;

means for connecting said supporting means to said support members; and means for moving said supporting means, said moving means including first and second gears, said first gear connected to said connecting means and meshing with said second gear to allow sliding of said connecting means along said support members, and motor means for allowing sliding of said connecting means.

16. A bed raiser as recited in claim 15, wherein said moving means further comprises an elongated internal guide rod slidably disposed within each said support member, said guide rod connected to said first gear.

17. A bed raiser as recited in claim 16, wherein said first gear is linear.

18. A bed raiser as recited in claim 17, wherein said second gear is circular.

19. A bed raiser as recited in claim 18, wherein said motor is operatively connected to said circular gear, said motor operating said circular gear to allow the sliding of said linear gear to raise and lower said supporting means.

* * * * *